United States Patent [19]

Kesler

[11] Patent Number: 4,612,917

[45] Date of Patent: Sep. 23, 1986

[54] PASSIVE EXERCISE MACHINE

[76] Inventor: Sylvan W. Kesler, 1821 Greendale, Anchorage, Ak. 99504

[21] Appl. No.: 660,928

[22] Filed: Oct. 15, 1984

[51] Int. Cl.[4] ..... A61H 1/00

[52] U.S. Cl. ..... 128/33; 128/63

[58] Field of Search ..... 128/25 R, 33, 58, 63

[56] References Cited

U.S. PATENT DOCUMENTS

| | | | |
|---|---|---|---|
| 1,158,779 | 11/1915 | Bolger | 128/25 R |
| 1,291,612 | 1/1919 | Niles | 128/58 X |
| 1,482,173 | 1/1924 | Willard | 128/25 R |
| 1,868,452 | 7/1932 | Whitney | 128/33 |
| 1,953,424 | 4/1934 | Miller | 128/33 |
| 2,497,751 | 2/1950 | Wettlanfer | 128/33 |
| 2,548,408 | 1/1951 | Tammen . | |
| 2,869,539 | 1/1959 | Mosse | 128/33 |
| 2,886,028 | 5/1959 | Vogtman | 128/25 R |
| 2,893,380 | 7/1959 | Walker | 128/25 R |
| 2,990,720 | 4/1961 | Scholtes . | |
| 3,207,152 | 9/1965 | Thornton | 128/33 |
| 3,381,538 | 5/1968 | Runde | 128/63 X |
| 3,895,623 | 7/1975 | Mahlandt | 128/25 R |

*Primary Examiner*—Clifford D. Crowder

*Attorney, Agent, or Firm*—William D. Hall

[57] ABSTRACT

A passive exercise machine has a head pad on which the patient's head rests, two shoulder pads on which the patient's right and left shoulders respectively rest, two buttock pads on which the patient's right and left buttock respectively rest, and two foot pads. The aforesaid seven pads move respecting each other in predetermined ways. Two hip pads are mounted on the two buttock pads respectively. The right hip pad presses tightly against the outside of the patient's body at the right hip, and the left hip pad presses tightly against the outside of the patient's body at the left hip. Hence, the two hip pads, working together, provide a repetitive squeezing and loosening action against the patient's hips. Weighted midriff and waist belts are wrapped around the patient to cause friction over the upper torso and waist areas, and to create more strenuous exercise and a faster weight loss. An adjustable reciprocating arm over the head pad is provided.

14 Claims, 10 Drawing Figures

PASSIVE EXERCISE MACHINE

BACKGROUND OF THE INVENTION

Passive exercise machines have been used over a number of years to provide exercise and weight loss for the user. Such mechanical devices comprise components and attachments which move various parts of the body such as arms, shoulders, hips and legs individually or collectively, to tone up muscles and to breakdown fat tissues.

The prior art includes a passive exerciser described in the next three paragraphs:

The machine comprises a series of cushions or pads for different parts of the body and these pads move with respect to each other in a predetermined manner. The patient lies on his or her back while these pads move. There is a head pad at the forward end of the machine, on which the patient's head is placed. The head pad is stationary. There are two shoulder pads for supporting the patient's two shoulders respectively. The shoulder pads move with a teeter-totter motion (an out of phase mode), i.e. when the front end of the left shoulder pad goes up, the front end of the right shoulder pad goes down. There are two buttock pads, on which the patient's right buttock and left buttock respectively, rest. The two buttock pads move with an oscillating motion caused by eccentric drives from a motor. The teeter-totter motion of the shoulder pads is at a faster rate than the oscillating motion of the buttock pads.

There are two foot pads, for the right foot and the left foot respectively. These two pads operate in an out-of-phase rocking motion.

The shoulder, buttock and hip pads are controlled by a timing device which provides five different operating modes.

As the shoulder, buttock and foot pads move individually and/or collectively, the patient with hands over head, holds onto a reciprocating arm, so that the patient will experience a stretching and loosening motion as the reciprocating arm moves back and forth.

SUMMARY OF THE INVENTION

Modifications have been made in the exercise machine, just described, to improve the performance. The three most important modifications are as follows:

(1) A pair of hip pads are carried by the buttock pads, respectively, and press tightly against the outside of the patient's body, at the right hip, and the outside of the patient's body at the left hip, to provide a repetitive squeezing and loosening action against the patient's hips and a faster weight and inch (size) loss for the patient.

(2) The reciprocating arm can be positioned at a suitable height and at a suitable lateral position above the fixed head pad by adjusting the support for the arm to a desired position. A comfortable but effective positioning of arm 3 will result in exercise of the arms and shoulders of the user (patient), irrespective of the height or weight of the patient.

(3) Weighted midriff and waist belts are wrapped around the user to cause friction over the upper torso and waist areas, and to create a more strenuous exercise and a faster weight loss. The midriff belt is held in operating position by the shoulder pads, and the waist belt is held in operating position by the hip pads.

BRIEF DESCRIPTION OF THE DRAWINGS

The accompanying drawings in conjunction with the description will make the invention more readily understood.

DESCRIPTION OF THE PREFERRED EMBODIMENT

Figure 1:
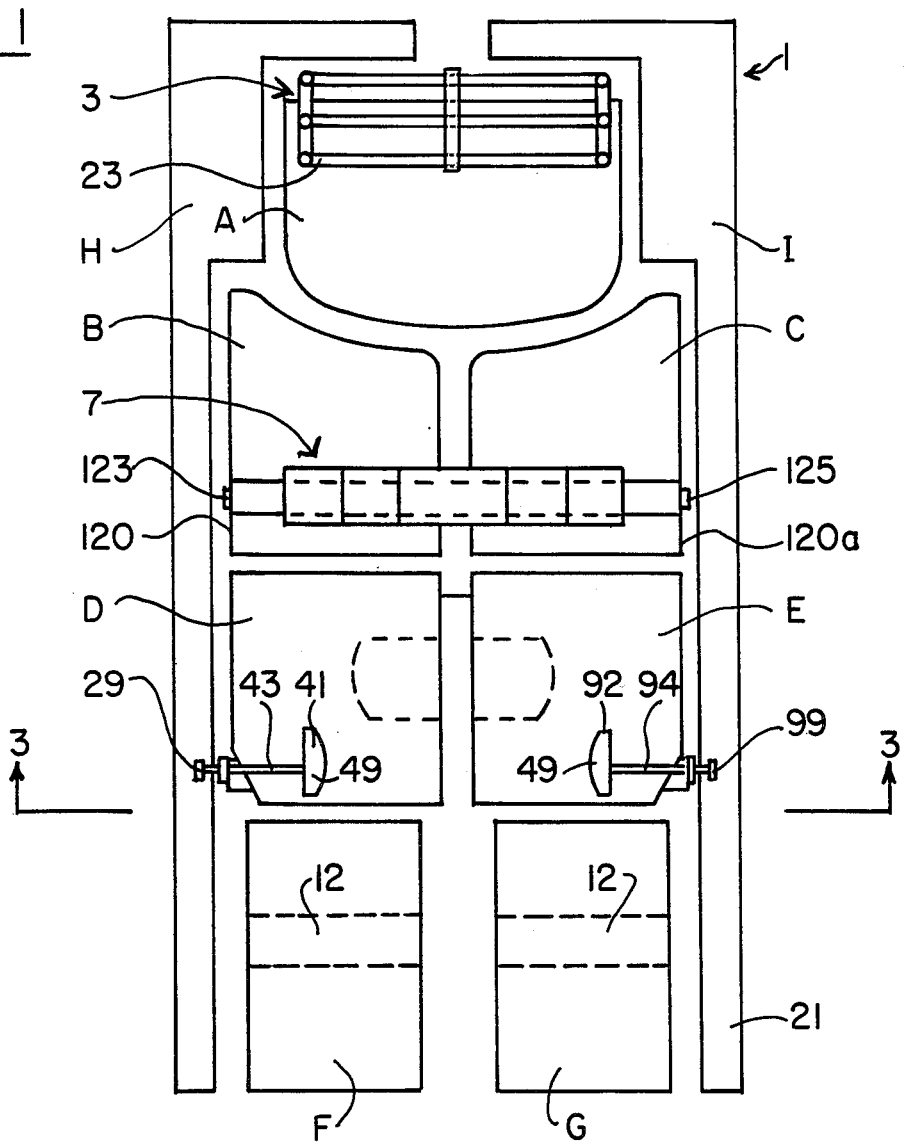
FIG. 1 is a plan view of the machine.

The exercise machine shown in FIG. 1 comprises a cast aluminum frame 1 with various pads A through I on which the patient may lie down safely. The frame 21 protects the user from falling off of the exercise machine. The head pad A is stationary. Shoulder pads B and C have a rocking motion; that is as the front end of pad B moves down the front end of pad C moves up, and vice-versa. Buttock pads D and E have identations to fit the tail and hip bones of the user. The pads D and E are driven in a synchronized mode so that the pads D and E oscillate toward and away from each other.

Figure 2:
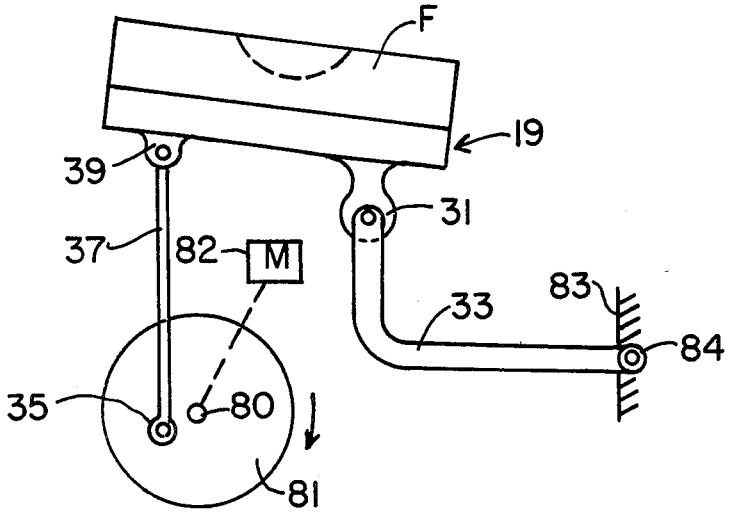
FIG. 2 is the side view of the foot pad support and drive mechanism.

Foot pads F and G have suitable indents 12 shaped to receive the left foot and the right foot of the patient, respectively. FIG. 2 shows the mechanism to cause the seating box 19, which supports foot pad F, to provide a rocking motion. Connecting brackets 31 and 39 are cast to the bottom of seating box 19. A disc 81 is rotated about a stationary shaft 80, by a suitable motor 82. A straight rod 37 is pivoted at one of its ends to bracket 39 and at its other end to an eccentric pin 35 on disc 81 to provide the rocking motion. A bent rod 33 is pivoted to bracket 31 at the forward end of seating box 19 and pivoted at its other end 84 to the machine frame 83. The members 33 and 37 support seating box 19 and in turn pads F.

Pad G is supported and moved, by apparatus identical to parts 19, 31, 33, 35, 37, 39, 80, 81, 82, 83 and 84, and in a manner identical to that of pad F, except that pad G rocks 180° out-of-phase with pad F, that is when pad G is swinging clockwise, pad F is swinging counterclockwise. The motor 82 and shaft 82*a* may drive the apparatus for rocking pad G as well as the apparatus that drives pad F.

Figure 3:
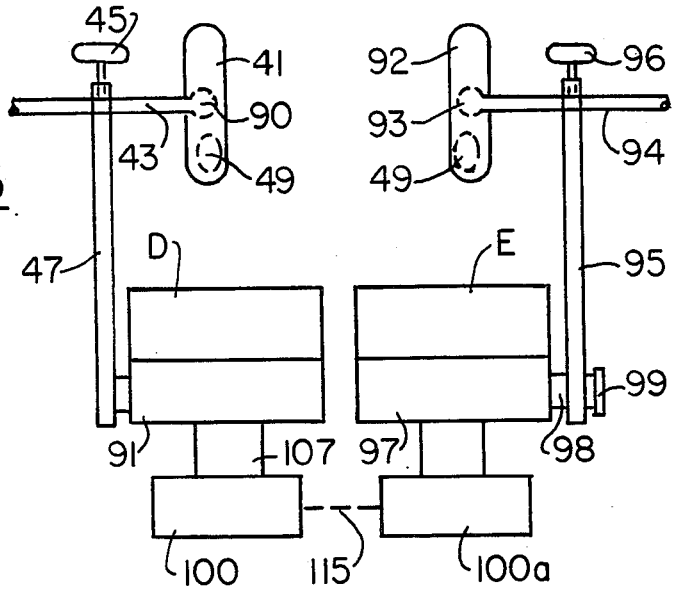
FIG. 3 is a view, of the hip pads and their connections to the seating boxes for the buttock (hip) pads D and E, taken along line 3—3 of FIG. 1.

The hip pad 41 in FIG. 3 is joined to the extension rod 43 by ball and socket joint 90, and the hip pad 41 is contoured to fit perfectly on the patient's hip muscle. The horizontal rod 43 and thereon the hip pad 41 can be locked to the vertical strut 47, at any position depending upon the size of the hip, by tightening the bolt 45. The vertical strut 47 is held in a socket 98 which is connected to the side of the seating box 91 which carries pad D. As the buttock pads D and E move, the two hip pads 41 will alternately move toward and away from each other to provide a massaging effect on the hip muscles under varying pressure, as will appear.

The hip pad 92 is supported in the same manner as hip pad 41. That is, hip pad 92 is connected by pivot 93 to horizontal rod 94 which can be locked to vertical strut 95 by tightening bolt 96. The vertical strut 95 is secured to seating box 97 via socket 98 (which is firmly secured to seating box 97) and bolt 99. (See FIG. 3).

Figure 8:
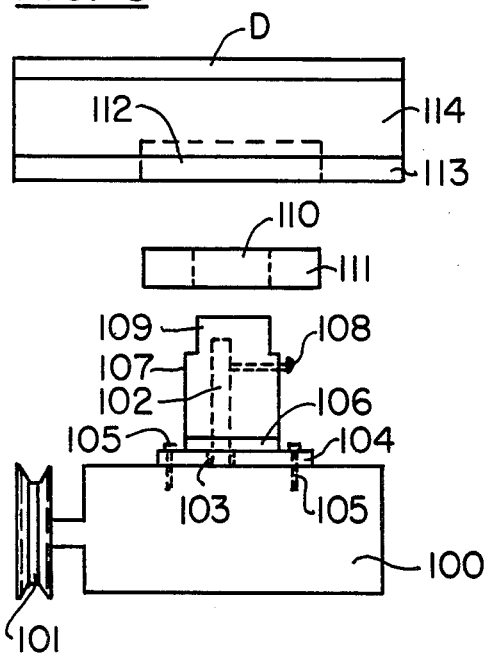
FIG. 8 is an end view of the support for, and the driving mechanism for, buttock pad D.
Figure 9:
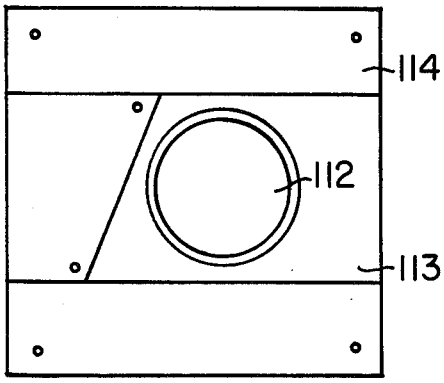
FIG. 9 is a bottom view of the seating boxes of pads D and E.

The apparatus for driving the buttock pads D and E is shown in FIG. 8.

The gear box housing 100 employs suitable speed reducing means including worm gear (not shown) for reducing the speed at input pulley 101 to a suitable speed (in the order of ten revolutions per second) for vertical shaft 102. Vertical shaft 102 passes through a hole 103 in plate 104 which is bolted to housing 100 by bolts 105. The shaft 102 passes through grease packed ball bearing thrust washer 106 and then passes off-center through stub shaft 107. The vertical shaft 102 is held in a drive relation with stub shaft 107 by set screw 108.

Since the axis of shaft 102 is spaced from the centerline of stub-shaft 107, the stub-shaft 107 rotates in an eccentric manner. The amount by which vertical shaft 102 is off-center determines the amplitude of the oscillating movement of pad D. The restricted end 109 of stub-shaft 107 fits tightly in the opening 110 of single row ball bearing 111. The ball bearing 111 in turn fits tightly in the cylindrical indent 112 in the steel plate 113 on the lower side of seating box 114 which in turn holds buttock pad D. Therefore, pad D assumes an eccentric motion conforming to that of stub-shaft 107. However, the pad D is not rotated since the ball bearing 111 only transmits to seating box 114, the eccentric component of motion of stub-shaft 107.

Buttock pad D is supported entirely by the parts shown in FIG. 8; and therefore buttock pad D rotates in an eccentric manner conforming to the eccentric motion of stub-shaft 107.

A mechanism identical with that shown in FIG. 8 is provided for buttock pad E so that it also rotates in an eccentric manner.

The respective mechanisms for rotating pads D and E may operate in synchronism with each other in which event the respective mechanisms would be constructed to cause pad D to be moving to the right at the same time that pad E is moving to the left, so that the pads D and E alternately move toward and away from each other. Alternatively, the mechanisms D and E need not be synchronized, but may randomly move the pads D and E toward and away from each other. The synchronized mode is shown in FIG. 3, and simply involves an interconnection 115 between gear box 100 (which supports pad D) and the gear box 100*a* (which supports pad E) so that the motions of the two pads D and E are synchronized.

Figure 10:
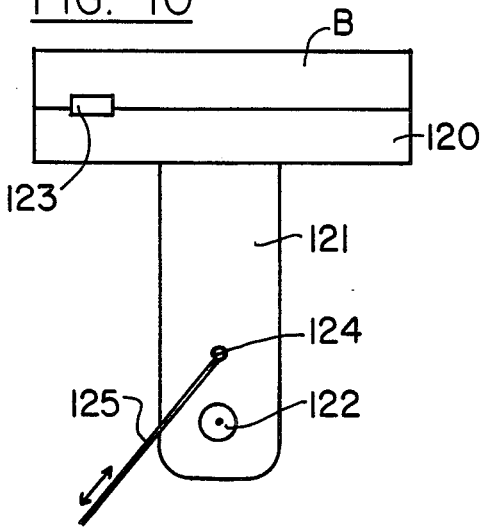
FIG. 10 is a side view of the support for, and the driving mechanism for, shoulder pad B.

FIG. 10 illustrates the mechanism for rocking pad B. Pad B is supported by box 120 which in turn is supported by post 121 which is pivoted about stationary shaft 122. The pad B is caused to rock about shaft 122 by reciprocating arm 125 pivoted to post 121 at 124.

Pad C is supported and rocked in a manner identical to pad B, except that when pad B is rocking clockwise the pad C is rotating counterclockwise. That is when the head end (the end closest to pad A) of pad B is going down, the head end of pad C is going up, and vice-versa. Both pads B and C rotate about shaft 122, back and forth a few angular degrees, for example, a total of ten degrees.

Attachment element 123 is mounted on one side of box 120 and a similar attachment element 125 is mounted on on a similar box 120*a* which holds pad C. The various belts described in connection with FIGS. 6 and 7 are held by attachment elements 123 and 125, as hereinafter described.

Figure 4:
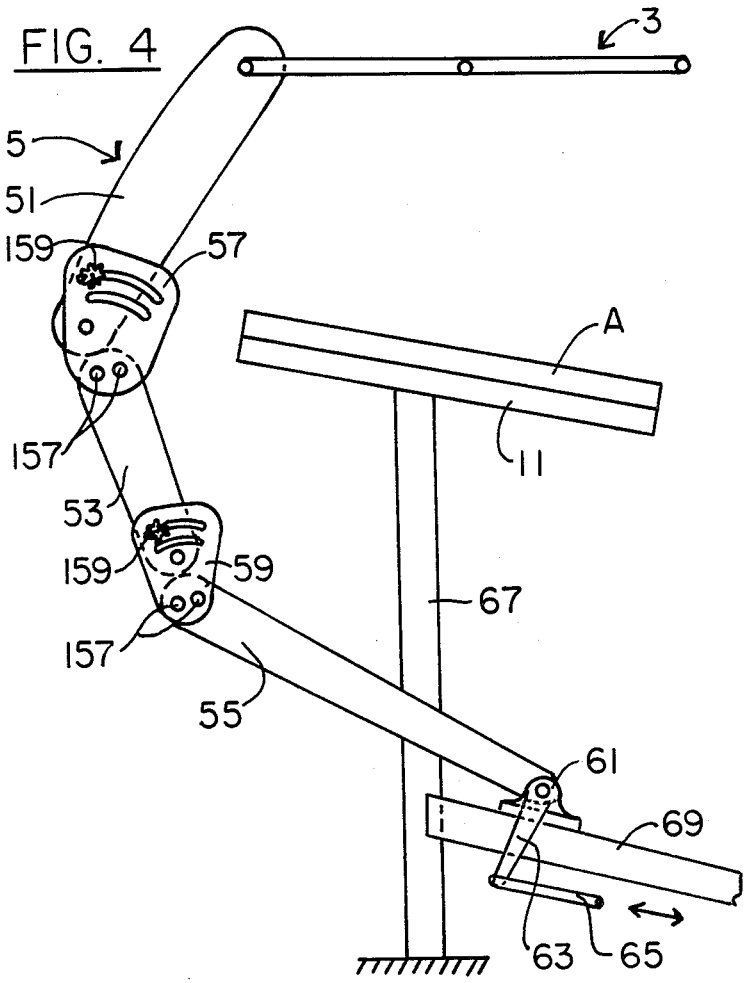
FIG. 4 is the side view of the crane support for the arm.
Figure 5:
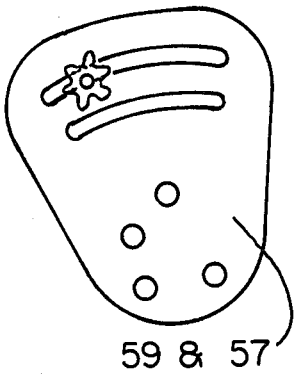
FIG. 5 is a detailed view of parts 57 and 59, of FIG. 4.

FIG. 4 shows the crane support 5 for arm 3 comprising three members. Adjustable connecting plate members 51 and 53 at the desired angle between them. Similarly, adjustable connecting plate 59 can be adjusted to provide the desired angle between members 53 and 55. The lower end of member 55 is pivoted to fixed support 61 which is bolted to the inclined beam 69 of the machine. The crank rod 63 is an integral part of member 55, and a push-pull rod 65 is connected to the crank rod 63 at one end to a reciprocating power source at the other end. A small angular movement of crank rod 63 will be manifested several times at arm 3. A significant movement of the arm 3 away from the head cushion A will stretch the arms and upper part of the user's body in order to breakdown the fat tissues around the shoulders and hips. The adjustable connecting plates 57 and 59 are attached at their lower ends to members 53 and 55 respectively, by bolts 157. Bolt 159 connects plate 57 to member 51 and may be loosened for purposes of adjustment. Similarly, plate 59 is secured to member 53 by a bolt 159. The head pad A is held in a stationary position in any suitable way. One end of the inclined beam 69 is welded to the lower end of aluminum vertical channel 67, so that the crane supported arm-bars will be positioned above the head cushion within reach of the patient's hands.

A common motor (not shown) may reciprocate rod 65 (FIG. 4) and rod 125 (FIG. 10).

Figure 6:
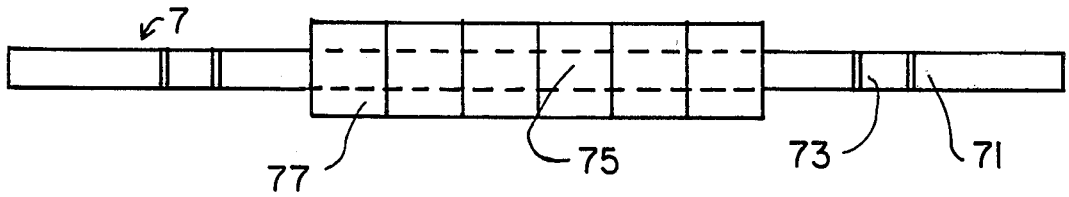
FIG. 6 is a top view of a midriff belt used with the invention.
Figure 7:
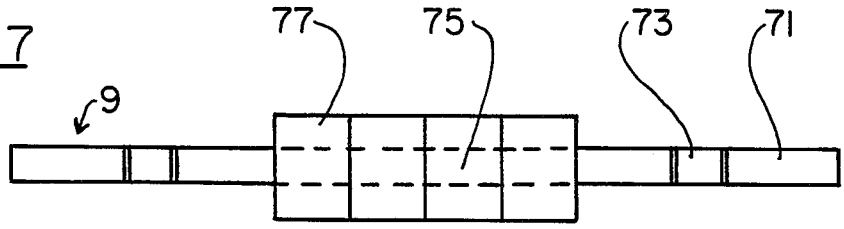
FIG. 7 is a top view of a waist belt used with the invention.

FIGS. 6 and 7 shows the six-compartment-weighted midriff belt 7 and the four-compartment-weighted waist belt 9. Midriff belt 7 weighs $7\frac{1}{2}$ lbs. and waist belt 9 weighs 5 lbs.; and both have middle belting 75 three inches in width sewed onto the required number of weighted compartments 77. The two ends of the belts 71 are made of hook type Velcro three inches wide sewed onto a cloth backing. Each end of the middle belting 75 is sewed to a surgical rubber element 73 whose other end is sewed to an end belting 71. The surgical rubber element 73 allows slight stretching movements as the user breathes freely during exercising.

It should be pointed out that the midriff and waist belts are similar in design; and either may be used as a supplemental belt to the other. Weighted-compartments 77 are stuffed with heavy material, and additional weighted-compartments 77 can be secured by Velcro onto the two standard types of midriff and waist belts described. The choice of various combination of belting will allow different compaction to deal with different density, i.e. liquidy or muscle impregnated fatty tissues of the patient imposing much more streneous exercise in order to achieve faster weight loss, better body toning and muscle control.

The midriff belt 7 can be attached at its end to the Velcro materials 123 and 125 respectively, (see FIGS. 1 and 10), secured to the shoulder pads B and C. The two ends of waist belt 9, on the other hand, can be attached to the Velcro material 49 secured to the hip pads 41 (see FIG. 3). The waist belt 9 when pressed onto the hips of the user will also press the weighted-compartments 77 of the waist belt 9 onto the abdoman area of the user during the machine operation.

The belts of FIGS. 6 and 7 both engage the patient's mid-section, that is the portion of the patient's body below the head and above the legs.

The inventions involved in this case are improvements on a prior art commercial machine. The prior art commercial machine is the same, patentwise, as the machine shown in the drawings of this case, if the following parts are omitted:

(1) Hip pads 41 and 92 and associated parts 29, 45, 47, 43, 49, 90, and 93 to 99.

(2) The various belts (including the weights and other parts carried by the belts), shown and described in connection with FIGS. 6 and 7, and the supports for those belts.

(3) The fact that the crane 51, 53 and 55 (FIG. 4) is in three sections with intervening adjustable parts 57 and 59, etc. is new and a part of my invention.

The prior art machine described above included a timer (not shown in this case), for operating the prior art machine through five cycles as follows:

Cycle 1—The arm bar 23 rocks, and the shoulder pads B and C move, as described above.

Cycle 2—The arm bar 23 rocks, along with the rocking motions of the shoulder pads B and C and the eccentric motions of buttock pads D and E.

Cycle 3—The buttock pads D and E move with eccentric motions.

Cycle 4—The leg or foot pads F and G move as described above in connection with FIG. 2.

Cycle 5—The arm 23 reciprocates, the shoulder pads B and C rock, and the leg or foot pads F and G rock.

The aforesaid cycles may be used with my invention, however, I prefer that, in cycle 5, the buttock pads D and E would also move in the manner described above.

My invention is not merely the additon of several components to the aforesaid prior art machine since the devices which I have added uniquely cooperate with the parts of the prior art machine as well as with each other. The cooperation is defined in the appended claims.

I claim to have invented:

1. A machine for massaging a patient, comprising:

support means for supporting a patient, said support means including first and second adjacent buttock supports for supporting the right buttock and the left buttock, respectively, of a patient, means for intermittently moving said first and second buttock supports toward and away from each other, and means for intermittently squeezing the hips of a patient, including:

(a) first and second hip-engaging elements for respectively engaging the outside of the patient's body at the left hip and the outside of the patient's body at the right hip, and (b) means supporting said first hip-engaging element from said first buttock support and said second hip-engaging element from said second buttock support, whereby said first and second hip-engaging elements move toward each other when said first and second buttock supports move toward each other, thus applying a squeezing force to the hips of the patient.

2. A machine for massaging a patient, as defined in claim 1, in which:

said buttock supports comprising first and second padded elements having generally horizontal upper surfaces.

3. A machine for massaging a patient, as defined in claim 2, in which said padded elements are configured to receive the rump of the patient.

4. A machine for massaging a patient, as defined in claim 1, in which each of said hip-engaging elements includes a pad for engaging an outer part of the patient's body at a hip.

5. A machine for massaging a patient's body, as defined in claim 4, in which said first and second buttock supports comprise first and second padded elements having a generally horizontal upper surface.

6. A machine for massaging a patient's body, as defined in claim 1, including a belt extending across the abdomen of the patient and connected at one side of said abdomen to said first buttock support and connected at the other side of said abdomen to said second buttock support.

7. A machine as defined in claim 6 in which said belt includes elastic means for allowing said belt to elongate.

8. A machine as defined in claim 6 in which said belt includes massive means for providing mass to the belt in the region of contact between the belt and the abdomen of the patient.

9. A machine as defined in claim 8 in which said belt includes elastic means for allowing the belt to elongate.

10. A machine for massaging a patient, comprising support means for supporting a patient, said support means having at least first and second portions that support right and left sides of the patient, respectively, in the region of the patient's mid-section, and which portions move with respect to each other to move different parts of the patient's body in the region of the mid-section in different ways, and a band extending across the patient at or near the mid-section of the patient and attached to said first and second portions, in which said two portions repeatedly move toward and away from each other, a first hip pad carried by one of said two portions for engaging the outside of the patient's body at the left hip and a second hip pad carried by the other one of said two portions for engaging the outside of the patient's body at the right hip, to thereby repeatedly apply a squeezing pressure to the patient between the portions of the patient's body contacted by said pads, respectively.

11. A machine for providing passive exercise to a patient comprising:

support means for supporting a patient, said support means having a head end for receiving the patient's head and also having separate supporting portions for a part of the patient above the waist, the patient's rump and the patient's legs, means for moving said separate supporting portions in different directions to thereby provide passive exercise for the patient, an arm which the patient may grasp and which is located near the head of a patient supported on said support means, and means for reciprocating said arm, holding means for holding said arm, said holding means comprising first, second and third sections, each of which sections has first and second ends, means located underneath said support means for supporting the first end of said first section, means pivotally connecting the second end of the first section to the first end of the second section, for enabling the angular relation between said first and second sections to be adjusted, means pivotally connecting the second end of the second section to the first end of the third section, for enabling the angular relation between said second and third sections to be adjusted, said sections forming an arc of a curve extending from said first end of said first section around said head end and to said arm, and means connecting the second end of the third section to said arm.

12. A machine as defined in claim 11, in which said supporting portions comprise all of the following:

(a) first and second shoulder pads, for the left and right shoulder areas of the patient, respectively (b) first and second buttock pads, for the left buttock and the right buttock of the patient respectively, and (c) first and second foot pads, for the left foot and the right foot, of the patient, respectively.

13. A machine as defined in claim 12 having means for moving said first and second buttock pads toward and away from each other repeatedly.

14. A machine as defined in claim 13 having a first hip pad which engages the outside of the patient's body at the left hip and a second hip pad which engages the outside of the patient's body at the right hip, so that the hip pads apply a compression force to the patient when the first and second buttock pads move toward each other.

* * * * *